United States Patent [19]

Duthweiler

[11] 4,192,630

[45] Mar. 11, 1980

[54] METHOD AND APPARATUS FOR BUILDING ICE ISLANDS

[75] Inventor: Frederick C. Duthweiler, Anchorage, Ak.

[73] Assignee: Union Oil Company of California, Brea, Calif.

[21] Appl. No.: 952,547

[22] Filed: Oct. 18, 1978

[51] Int. Cl.[2] ..... E02B 3/00

[52] U.S. Cl. ..... 405/217; 62/260; 405/195

[58] Field of Search ..... 405/217, 195; 62/1, 62/259, 260; 165/45; 166/242

[56] References Cited

U.S. PATENT DOCUMENTS

| | | | |
|---|---|---|---|
| 3,730,211 | 5/1973 | DeLaine et al. | 137/334 |
| 3,738,114 | 6/1973 | Bishop | 405/217 |
| 3,750,412 | 8/1973 | Fitch et al. | 405/217 |
| 3,849,993 | 11/1974 | Robinson et al. | 405/217 |
| 3,863,456 | 2/1975 | Durning et al. | 405/217 |
| 4,048,808 | 9/1977 | Duthweiler | 405/217 |
| 4,094,149 | 6/1978 | Thompson et al. | 405/217 X |

OTHER PUBLICATIONS

Offshore Drilling from Ice Platforms Journal of Petroleum Technology, Apr. 1976, pp. 379–384.

Island of Ice, Seventy Six Magazine, Jul./Aug. 1977, pp. 22–27.

*Primary Examiner*—Dennis L. Taylor

*Attorney, Agent, or Firm*—Dean Sandford; Daniel R. Farrell

[57] ABSTRACT

Method and apparatus for building a thickened ice mass, such as a grounded ice island, at a cold offshore location, in which water is pumped through a fluid flow conduit and discharged from a rotating swing arm section of the conduit onto selected areas of a natural ice sheet to form circular and/or annular thickened ice bodies. The fluid flow conduit includes a first water supply line disposed in the water body between the ice sheet and the marine bottom, and, if required, a second water supply line which is installed along the top surface of the ice island after the grounding of the ice body forces abandonment of the first water supply line.

27 Claims, 10 Drawing Figures

METHOD AND APPARATUS FOR BUILDING ICE ISLANDS

BACKGROUND OF THE INVENTION

1. Field of the Invention

This invention relates to a method and apparatus for building thickened ice masses for offshore operations in cold water, and particularly to a method and apparatus for building ice islands suitable for use as work platforms in cold offshore locations.

2. Description of the Prior Art

In the continuing search for new petroleum and natural gas reservoirs, considerable interest has recently been focused on exploration and production activities in the arctic and antarctic regions of the world. In these areas, subterranean formations having potential for petroleum and/or natural gas accumulations are sometimes found underlying ice-covered offshore locations which have relatively shallow waters. Conventional floating platforms are not well suited for operations in these waters.

Various types of bottom-supported platforms have been suggested for use in these offshore locations including platforms constructed from steel, concrete and/or fill material dredged from the marine bottom. These platforms are relatively expensive to construct and are expensive to remove after the operations are terminated.

Ice has been proposed for use as the construction material for bottom-supported platforms. Grounded ice islands can be constructed by depositing water over a natural ice sheet to thicken the ice mass until its draft is greater than the water depth and at least part of the thickened ice mass is grounded on the marine bottom. U.S. Pat. No. 4,048,808 to Duthweiler, U.S. Pat. No. 3,863,456 to Durning and U.S. Pat. No. 3,849,993 to Robinson et al. disclose methods for building ice islands in which water is sprayed or flowed onto a natural ice sheet to form a grounded ice island.

Ice islands appear to be feasible for use as work platforms from which to conduct operations such as exploratory drilling, and perhaps, under the proper conditions, for year-around drilling and/or production. However, in most of the offshore areas which are candidates for the use of ice islands, the natural ice sheet and ice island will break up and melt during the warmer summer months. The time available for construction of the ice island and drilling of the well is often limited to five months or less and the time available is rarely more than eight months. A major portion of this time has been found to be required for the construction of the ice island, primarily due to the adverse working conditions and the limits of the apparati which have been used to build up the ice mass. For example, an ice island constructed by flooding water onto an enclosed area between snow berms on the natural ice sheet using manually controlled water pumps required more than two months to build. After the drilling rig was installed, only about two months remained to complete the drilling program before the drilling rig had to be removed. A need exists for a method and apparatus for more quickly building an ice island in order to allow more time for completion of the operations to be conducted from the ice island.

Accordingly, it is a primary object of this invention to provide a method and apparatus for rapidly constructing ice islands at cold offshore locations.

Another object of this invention is to provide an improved method and apparatus for building ice islands in a manner which is substantially unaffected by the adverse weather conditions and physical constraints which hindered rapid construction of ice islands with the prior art methods and apparati.

Yet another object of the invention is to provide a substantially completely mechanized apparatus and method for quickly building ice islands at cold offshore locations.

A further object of this invention is to provide an improved method and apparatus for building an ice island in a substantially continuous mechanized manner to thereby reduce the time required to complete the ice island construction.

Still further objects, advantages and features of the invention will become apparent to those skilled in the art from the following description taken in conjunction with the accompanying drawings.

SUMMARY OF THE INVENTION

Briefly, the invention provides an apparatus and method for building a thickened ice mass, such as a grounded ice island, at cold offshore locations having an ice sheet overlying a water body and a marine bottom. The apparatus of the invention includes (a) a fluid flow conduit comprised of a first water supply line disposed in the water body, a vertical standpipe extending through the ice sheet and a swing arm disposed above the ice sheet which is rotatable about the standpipe in a generally horizontal plane; (b) a plurality of outlet pipes fluid-tightly connected at selected spaced positions along the length of the swing arm for discharging water onto the underlying ice; (c) a water pump for pumping water through the fluid flow conduit to the outlet pipes; and (d) means for supporting the apparatus and for rotating the swing arm about the standpipe. Preferably the fluid flow conduit is insulated with suitable thermal insulation, such as inner and outer insulation layers tightly wrapped thereabout with heating tape disposed between the insulation layers. Preferably the outlet pipes also include spray nozzles for distributing the discharged water in uniform, thin layers over selected areas of the ice sheet. Nozzle heaters may be provided to prohibit premature freezing of the water.

In one preferred embodiment of the apparatus of this invention, the fluid flow conduit also includes a second water supply line section which is installed along the top surface of the ice island after the ice island has become grounded on the marine bottom.

In the method of this invention, water is pumped through the above-described fluid flow conduit and discharged from the outlet pipes as the swing arm is rotated, thereby discharging water onto the ice sheet in a circular pattern. Preferably this operation is continued at least until the circular ice body formed thereby becomes grounded on the marine bottom. Also preferably the rotational speed of the swing arm and the rate of water discharge are controlled to deposit relatively thin, uniform layers of water on the ice sheet during each revolution of the swing arm.

In one preferred embodiment of the method of this invention, the first water supply line of the fluid flow conduit is abandoned after the ice body becomes grounded and the second water supply line is installed as described above to continue the construction operation. In another preferred embodiment, the method also includes the step of discharging water onto the ice to form a thickened annular ice mass spaced from and concentric with the circular ice body.

The method and apparatus of this invention provide the very important advantage of permitting around-the-clock operation under even the most severe weather conditions with a minimum of operating surveillance and manual labor. The invention permits an increased rate of ice formation, thereby reducing the time required to build the ice island and allowing more time for subsequent drilling and/or production operations from the ice island. The apparatus of the invention has relatively few "weather sensitive" components and even these, such as the water pump, can easily be mounted in enclosures for protection from the elements. The weight of the apparatus of the invention can easily be distributed over the surface of the ice sheet to avoid local depressions which would accumulate excess water and result in nonuniform growth of the ice mass. Since the water pump can remain in one position throughout the construction operation, the invention eliminates the need to periodically drill new water holes through the ice sheet which often delayed prior art construction operations. The invention also results in increased rates of ice formation due to the uniform distribution of thin layers of water over the ice sheet, and because snow berms and the like are usually not required for containment of the discharged water.

BRIEF DESCRIPTION OF THE DRAWINGS

The invention will be more readily understood by reference to the drawings, wherein like numerals refer to like elements, in which.

DETAILED DESCRIPTION OF THE INVENTION

This invention provides an apparatus and method for building thickened ice masses at cold offshore locations. While the invention will herein be described in more detail by reference to the construction of a grounded ice island for offshore drilling and production operations, the invention is not so limited. Rather the invention can be used to build a wide variety of thickened ice masses, both grounded and ungrounded, such as landing strips for airplanes, roads and ship docking facilities, by separately and/or simultaneously forming a plurality of adjacent thickened ice masses.

Figure 1:
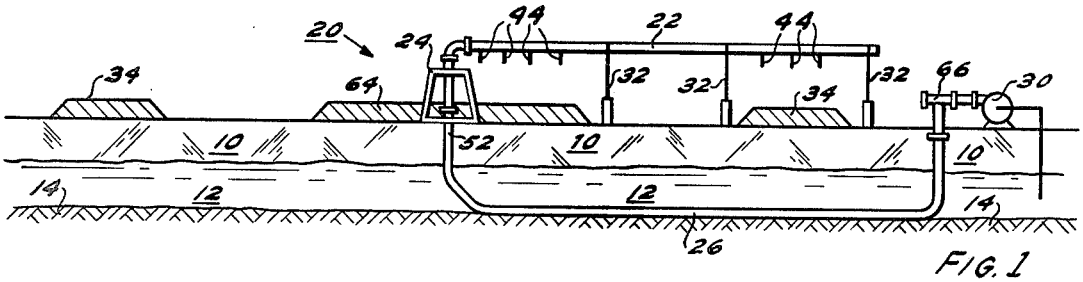
FIG. 1 is a vertical cross-sectional view of a natural ice sheet at an offshore location schematically illustrating an initial stage of one embodiment of the method and apparatus of this invention.

Referring to FIG. 1, natural ice sheet 10 floats on a body of water 12 over marine bottom 14 at the desired offshore location. The depth of water body 12 may range from a few feet to 30 feet or more, with a typical water depth being about 15 feet. Natural ice sheet 10 may range from about 2 feet to about 6 feet or more in thickness, depending upon its location and the time of year, and it may be a part of a polar ice pack or may be "fast ice" which is normally attached to a nearby land mass. Alternatively, natural ice sheet 10 may be a floating ice body or a cutout portion of a larger ice body which has been towed to the desired offshore location.

Figure 2:
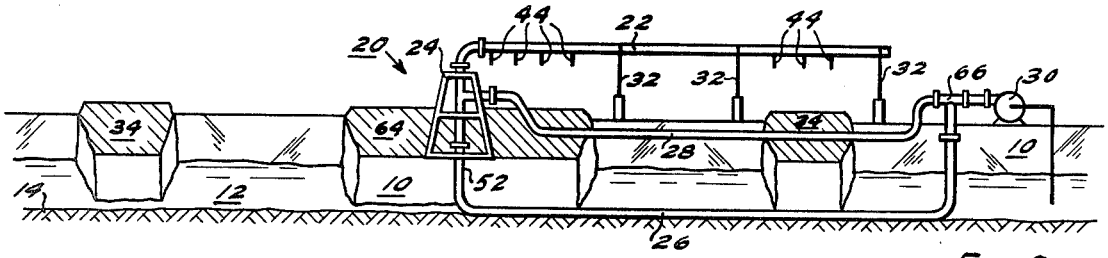
FIG. 2 is a vertical cross-sectional view of a natural ice sheet and formed ice masses at an offshore location schematically illustrating an intermediate stage of one embodiment of the method and apparatus of this invention.
Figure 3:
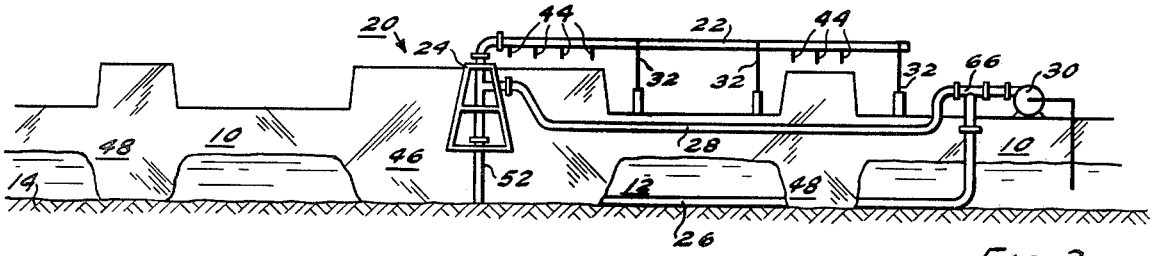
FIG. 3 is a vertical cross-sectional view of a grounded ice island at an offshore location schematically illustrating a final stage of one embodiment of the method and apparatus of this invention.

FIGS. 1 through 4 schematically illustrate various stages of the construction operation in which one embodiment of the apparatus of this invention, shown generally as 20, is employed to build a grounded ice island of the type described in my U.S. Pat. No. 4,048,808. Referring to FIGS. 2 and 3, the grounded ice island includes (1) circular ice mass 64 and the underlying circular section of ice sheet 10 which together define a circular grounded ice body 46; (2) annular ice mass 34 and the underlying annular section of ice sheet 10 which together define a grounded annular ice body 48; and (3) an ungrounded annular section of ice sheet 10 between ice body 46 and ice body 48. The various features and advantages of this ice island are fully described in U.S. Pat. No. 4,048,808, the disclosure of which is herein incorporated by reference.

Figure 4:
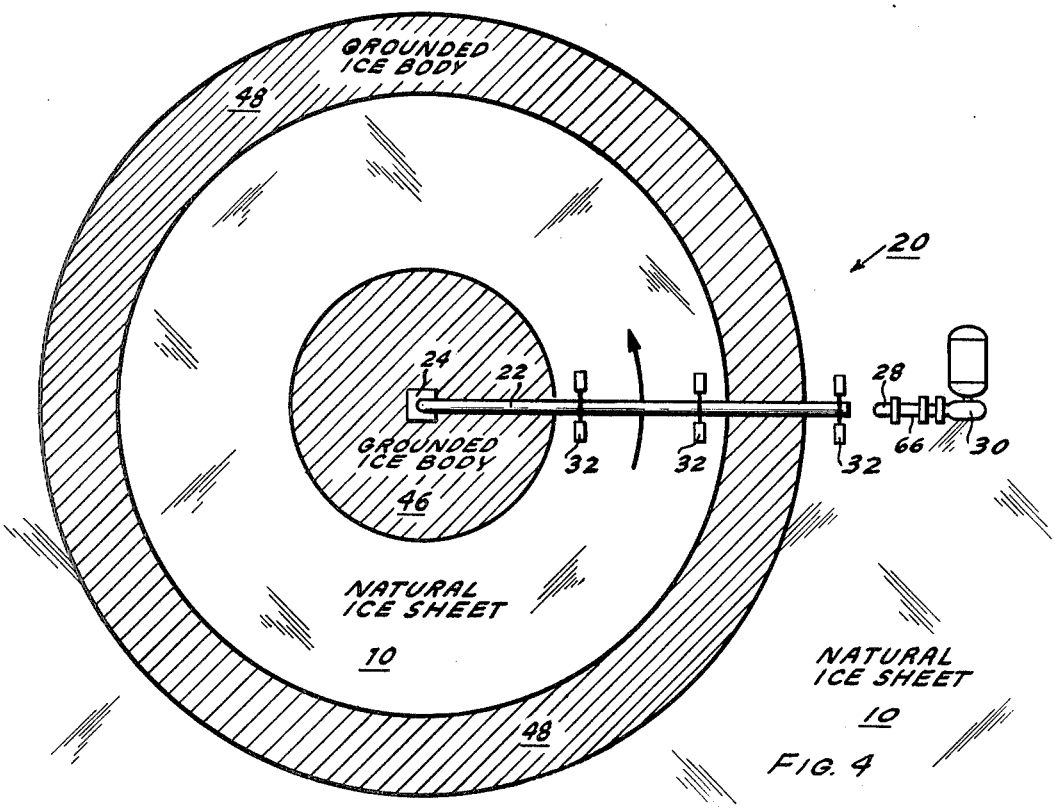
FIG. 4 is a plan view of the grounded ice island illustrated in FIG. 3.

The major component parts of apparatus 20 are water pump 30 and a fluid flow conduit comprising swing arm 22, vertical standpipe 52 and one of water supply lines 26 and 28. Swing arm 22 is rotatably supported by center-pivot structure 24 at the center of the area to be used for construction of the ice island, and is movably supported at spaced positions along its length by a plurality of tractors 32. Each span of swing arm 22 between these supports is supported in an elevated position a short distance, such as 5 to 20 feet, above the top surface of natural ice sheet 10 and above the top surface of the later formed ice masses, such that swing arm 22 can be rotated in a circular path about center-pivot structure 24, as illustrated in FIG. 4.

Figure 5:
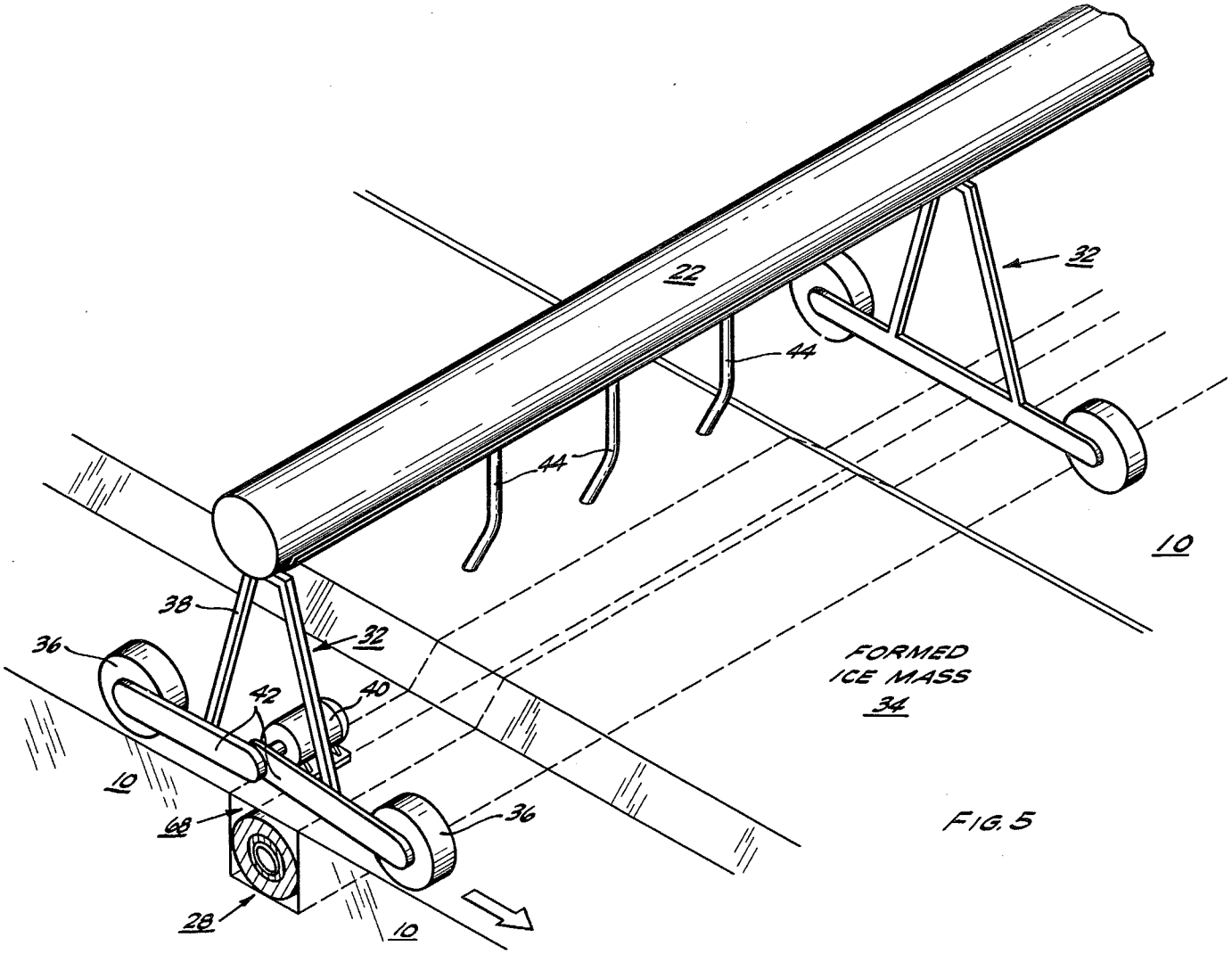
FIG. 5 is an isometric view illustrating a swing arm and a water supply line which form a part of one embodiment of the apparatus of this invention.

Referring to FIG. 5, the outermost span of swing arm 22 is supported between tractors 32 in an elevated position above the top surface of natural ice sheet 10 and above the top surface of formed ice mass 34. Each tractor 32 includes one or more wheels 36 rotatably mounted by bearings and axles, not shown, on tractor frame 38. Tractor frame 38 is a triangular truss structure standing in a substantially vertical plane which is substantially perpendicular to the axis of swing arm 22. In the preferred embodiment illustrated, prime mover 40 is fixedly supported on frame 38 and is operably connected by power transmission devices 42 to wheels 36.

Prime mover 40 drives wheels 36 through power transmission devices 42 to thereby rotate swing arm 22 in a circular path about center-pivot structure 24. Prime mover 40 and power transmission devices 42 are conventional devices, such as an internal combustion engine and a drive chain, or an electrical motor and a pulley or gear arrangement. Other prime movers and power transmission devices well known to those skilled in the art are suitable for use with tractor 32. Although not critical, each tractor 32 may have a driving mechanism, such as prime mover 40 and conversion device 42. It is also contemplated that a single driving mechanism mounted on one of tractors 32 may be used to rotate swing arm 22, or that a driving mechanism mounted on center-pivot structure 24 could be used to rotate swing arm 22. In selecting a particular driving mechanism, consideration must be given to distributing the weight of the entire apparatus across the surface of natural ice sheet 10 to avoid overly large depression, and perhaps collapse, of natural ice sheet 10. Accordingly, it is preferred that each tractor 32 be equipped with its own, preferably lightweight, driving mechanism.

As shown in FIG. 5, a plurality of outlet pipes 44 are positioned at spaced locations along the length of swing arm 22 to discharge water from swing arm 22 onto selected areas of the underlying ice. The water discharged from outlet pipes 44 falls onto the underlying ice and freezes to form ice mass 34. The shape and dimensions of the ice island are a matter of choice and the apparatus of this invention can be easily modified by selection of the length of swing arm 22 and the positions of outlet pipes 44 along swing arm 22 to form any circular and/or annular pattern desired. The water discharged from the outlet pipes 44 illustrated in FIG. 5 is shown forming annular ice mass 34 which, together with the underlying annular section of ice sheet 10, defines grounded ice body 48 as described above.

Figure 6:
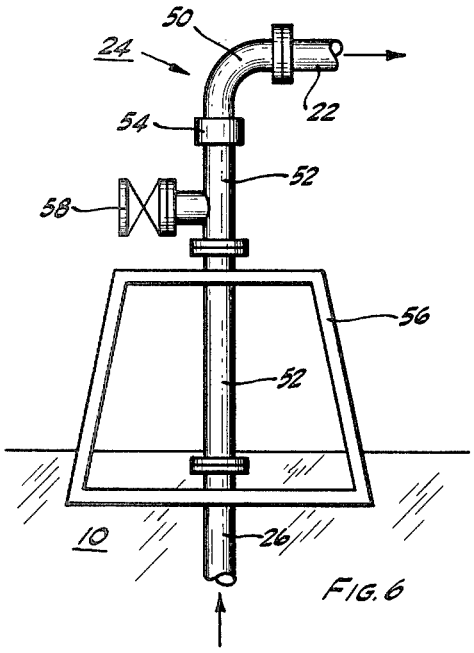
FIGS. 6 and 7 are side views illustrating a center-pivot support structure which forms a part of one embodiment of the apparatus of this invention.

Referring to FIG. 6, during the initial stages of the method of this invention center-pivot structure 24 includes: pipe elbow 50 fluid-tightly coupled to swing arm 22 and to standpipe 52 through swing joint 54; and support stand 56 fixedly coupled to standpipe 52 and natural ice sheet 10 to support the weight of center-pivot structure 24 and at least a portion of the weight of swing arm 22. Support stand 56 may be positioned on natural ice sheet 10 and fixedly attached thereto by flooding water around the base of support stand 56. Upon freezing, the water forms an integral ice mass with natural ice sheet 10 which anchors support stand 56. Alternatively, or in addition, one or more steel piles, not shown, can be driven through the base of support stand 56 and natural ice sheet 10 for attachment of support stand 56. Swing joint 54 allows continuous water flow from standpipe 52 to swing arm 22 during rotation of swing arm 22 about the axis of standpipe 52. Optionally, valve 58 is provided on a pipe tee in standpipe 52 to allow access to standpipe 52, as may be required during startup operations to allow preheating of the fluid flow conduit or to supply water to an auxiliary hose, not shown.

Figure 7:
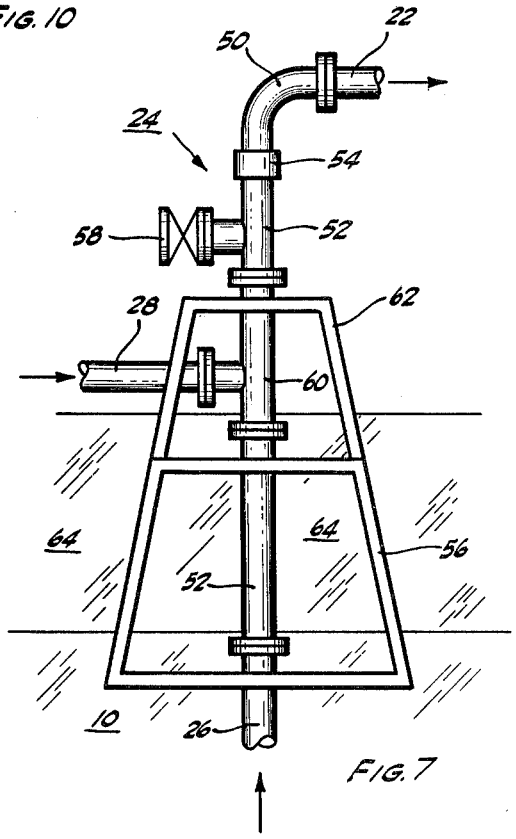

Referring to FIG. 7, during the later stages of the construction operation center-pivot structure 24 also includes: pipe tee 60 inserted into standpipe 52 to elevate swivel joint 54 and elbow 50, and to allow fluid-tight connection of water supply line 28 to standpipe 52; and auxiliary support stand 62 fixedly coupled to pipe tee 60 and support stand 56 to support swivel joint 54 and elbow 50 in this elevated position relative to the section of natural ice sheet 10 to which center-pivot structure 24 is attached. Pipe tee 60 and stand 62 are added to compensate for the movement of center-pivot structure 24 as the ice to which it is attached becomes depressed due to the accumulated weight of formed ice mass 64. Pipe tee 60 also provides a convenient point for connection of water supply line 28 when the ice island grounds and forces abandonment of water supply line 26. One or more pipe spaces, not shown, may be added for other adjustments in the elevation of swing joint 54 and elbow 50.

Referring to FIGS. 1 through 3, water supply line 26 is disposed in water body 12 between natural ice sheet 10 and marine bottom 14. The outlet of water supply line 26 is fluid-tightly connected to the inlet of standpipe 52 which in turn extends through natural ice sheet 10 at the center of the ice island area. The inlet of water supply line 26 extends through natural ice sheet 10 at a point outside the ice island area and is fluid-tightly connected through pipe tee 66 to water pump 30 which is supported on the top surface of natural ice sheet 10. Water supply line 26 must necessarily be somewhat flexible in order to adapt its position as sections of natural ice sheet 10 become depressed towards marine bottom 14 by the weight of formed ice masses 34 and 64. Preferably water supply line 26 is a flexible hose. Water supply line 26 is used to supply water from pump 30 to swing arm 22 during the initial stages of the construction operation, i.e., until ice body 46 and/or ice body 48 become grounded on marine bottom 14 and thereby prevent flow through water supply line 26.

Referring to FIGS. 2 and 7, water supply line 28 is disposed along, i.e., at or just below, the top surface of the ice island and fluid-tightly interconnects the outlet of water pump 30 via pipe tee 66 with standpipe 52 via pipe tee 60. FIG. 5 illustrates a preferred embodiment wherein water supply line 28 is installed in shallow trench 68 which extends through natural ice sheet 10 and formed ice mass 34. After installation of water supply line 28, trench 68 may be filled in with water, snow or ice to facilitate the smooth passage of wheels 36 over trench 68.

Water supply line 28 is provided as a replacement for water supply line 26 which typically will be rendered unusable by the grounding of the ice island. Of course, if water supply line 26 remains usable because the ice island is not grounded or because water supply line 26 settles into marine bottom 14 without being crushed, water supply line 28 may not be required. Water supply line 28 may be a fairly rigid conduit, such as a steel pipe, and should be installed only after downward movement of the ice masses on or through which it is installed has substantially ceased. Any significant ice movement after installation of water supply line 28 could severely stress, and perhaps rupture, water supply line 28. Preferably water supply line 28 is installed after the grounding of ice body 46 and/or ice body 48 has forced abandonment of water supply line 26.

In operation, as tractors 32 slowly rotate swing arm 22 about the axis of standpipe 52, water pump 30 pumps water from a source of water, such as water body 12, through pipe tee 66 and one of water supply lines 26 and 28, depending upon the stage of the construction operation, and then through standpipe 52 and swing arm 22 for discharge in a selected pattern from outlet pipes 44 onto the underlying ice. The discharged water freezes in thin, uniform layers on the underlying ice to form a circular formed ice mass 64 and an annular formed ice mass 34. Gradually the accumulating weight of ice masses 34 and 64 deforms sections of natural ice sheet 10, as shown in FIG. 2. Eventually, ice body 46 (comprised of a circular section if ice sheet 10 and formed ice mass 64) and ice body 48 (comprised of an annular section of ice sheet 10 and formed ice mass 34) become grounded on marine bottom 14, as shown in FIG. 3. If the grounding of ice bodies 46 and 48 forces the abandonment of water supply line 26, water supply line 28 is installed and put into service. The construction operation is then continued in order to build up ice bodies 46 and 48 to a desired height above the normal water level of water body 12.

The water which is used to form the ice island can be any water which freezes readily at the ambient atmospheric temperature of the offshore location. If available, fresh water is generally preferred over water containing large concentrations of dissolved salts and suspended solids due to its higher freezing point and the greater strength of the ice formed therefrom. As a practical matter, however, the water employed will usually be taken directly from water body 12.

The water must be kept at temperatures above its freezing point throughout apparatus 20 and is preferably discharged from outlet pipes 44 at a temperature within a few degrees, such as 1° to 10° F., above its freezing point so that the water will rapidly freeze when exposed to the atmosphere. In the rare case that the water supply is available at a temperature substantially above its freezing point, little or no insulation of the flow lines of apparatus 20 will be required. More commonly, the water supply will be available at a temperature just above its freezing point and precautions must be taken to avoid premature freezing of the water in apparatus 20. In some cases, conventional insulation alone will suffice to prohibit premature freezing and commercially available insulated conduits will be suitable for use as the sections of the fluid flow conduit which require insulation. For example, insulated pipes suitable for use in such cases are marketed by Cemco Products, Incorporated of Everett, Washington under the trademark Klondike pipe.

However, in other offshore locations, such as an offshore location having an ambient temperature of about −50° F. or below, more elaborate thermal insulation may be required. Schemes for thermally insulating fluid flow lines are well known in the art. A preferred insulating scheme is the use of heat tracing along the sections of the fluid flow conduit which are exposed to the atmosphere, such as swing arm 22 and standpipe 52, and those sections which are surrounded by ice, such as standpipe 52, water supply line 28 and any section of water supply line 26 which extends through the ice sheet. The section of water supply line 26 which is disposed in water body 12 will not usually require thermal insulation since the temperature of surrounding water body 12 is typically above the freezing point of the water flowing through water supply line 26. By means of the heat tracing, thermal energy is supplied along the fluid flow conduit to prevent premature freezing of the water flowing therethrough. Preferably the heat tracing is employed to keep the water temperature in the outlet pipes just a few degrees, such as from 0.5° to 5° F. above its freezing point.

The sections of the fluid flow conduit to be insulated can be heat-traced by wrapping an electrical heating tape directly on the conduit and then applying a layer of thermal insulation, such as a three-inch thick layer of foamed insulation. Alternatively the water-carrying conduit can be inserted in a larger diameter conduit to define an annular passage about the watercarrying conduit through which a heated fluid, such as heated air, may be forced to transfer thermal energy to the water.

Figure 8:
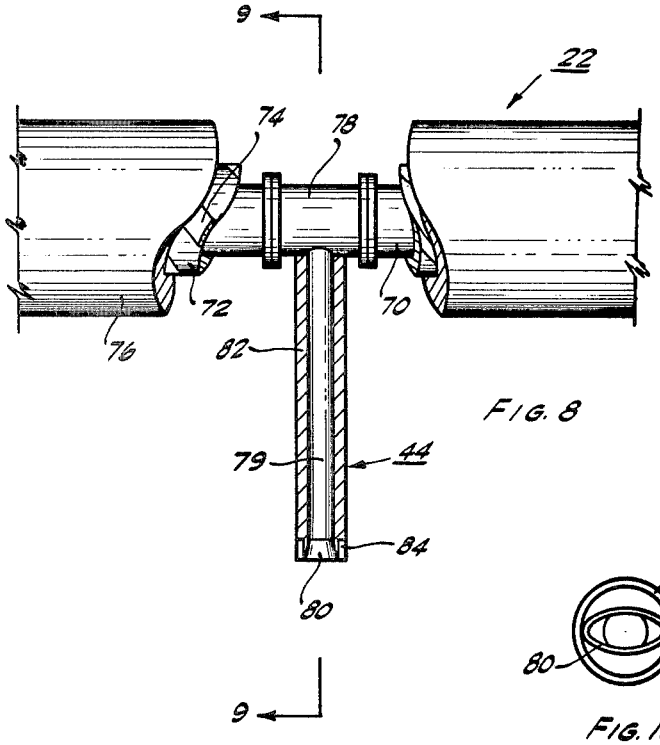
FIG. 8 is a side view illustrating a swing arm and outlet pipe which form a part of one embodiment of the apparatus of this invention, with a section of the insulation cut away to illustrate the underlying structure.
Figure 9:
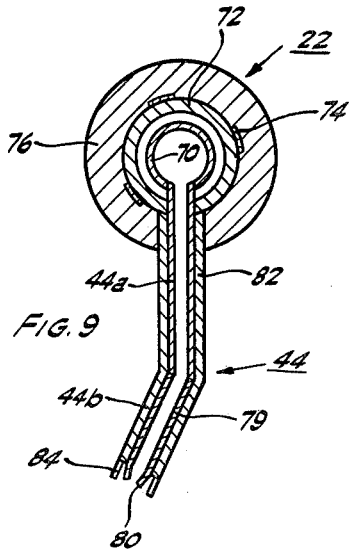
FIG. 9 is a cross-sectional view taken along line 9—9 of FIG. 8.
Figure 10:
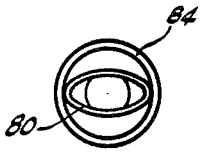
FIG. 10 is an end view illustrating one embodiment of a spray nozzle suitable for use on the discharge end of the outlet pipe of the apparatus.

FIGS. 8 through 10 illustrate a preferred scheme for insulating the sections of the fluid flow conduit which require thermal insulation. Referring to FIGS. 8 and 9, swing arm 22 includes: pipe 70 constructed of steel or other material which is designed for use at low temperature; inner insulation layer 72 tightly wrapped around pipe 70 and constructed of polyurethane foam or other suitable insulation material; heating tape 74 tightly wrapped in multiple strands around inner insulation layer 72 and connected to a power source, not shown, which controllably heats heating tape 74 to any desired temperature; and outer insulation layer 76 tightly wrapped around heating tape 74, insulation layer 72 and pipe 70.

By way of example, a suitably insulated conduit could be assembled as follows: a 4-inch diameter Klondike pipe having a 1-inch thick layer of insulation is purchased from Cemco Products, Inc.; three identical strands of electrical heating tape marketed by the Briscoe Manufacturing Company of Columbus, Ohio are tightly wound about the insulated Klondike pipe in coaxial, helical patterns; and a 2.5-inch thick layer of foamed insulation is tightly wrapped about the Klondike pipe and heating tape. One advantage of this insulation scheme is that the insulated conduits can be readily assembled from commercially available components.

FIGS. 8 through 10 also illustrate a preferred embodiment of outlet pipe 44. Outlet pipe 44 includes small diameter pipe 79 having its inlet fluid-tightly connected to pipe 70 through pipe tee 78. As shown in FIGS. 5 and 9, outlet pipe 44 preferably includes upper, substantially vertical section 44*a*, lower, inclined section 44*b*, and spray nozzle 80. Section 44*b* is inclined at an angle of about 10° to about 90° from vertical, preferably about 30° to 45° from vertical, in order to direct the discharged water behind rotating swing arm 22, i.e., the water is discharged in a direction opposite to the direction of rotation of swing arm 22, thereby avoiding the accumulation of ice on apparatus 20 itself.

Preferably, insulation layer 82 is tightly wrapped about pipe 79 and nozzle heater 84 is disposed about spray nozzle 80 to prohibit premature freezing of the water flowing therethrough. Spray nozzle 80 may be of conventional design, such as the ovalshaped outlet restriction illustrated in FIG. 10. Spray nozzles which discharge the water in a fine spray are preferred, because finely divided water droplets are more quickly cooled as they fall onto the underlying ice. Suitable nozzle heaters are commercially available, for example, from General Electric Corporation.

Preferably, spray nozzles 80 are designed to control the rate at which water is discharged through outlet pipes 44 such that the water is deposited in thin, substantially uniform layers on the underlying ice. For example, the opening of the spray nozzles nearest to standpipe 52 can be relatively small in cross-sectional area with the openings of the spray nozzles more remote from standpipe 52 being progressively larger. Alternatively, adjustable valves, not shown, could be provided on each outlet pipe 44 to regulate the water flow therethrough. Other devices and/or modifications to achieve this objective are known to those skilled in the art.

In one embodiment, the method of this invention comprises pumping water from a source of water, such as water body 12, through a fluid flow conduit defined by (1) a water supply line disposed in the water body between the ice sheet and the marine bottom, (2) a vertical standpipe extending through the ice sheet and (3) a swing arm disposed in an elevated position above the ice sheet; rotating the swing arm about the standpipe in a generally horizontal plane; and discharging water from the swing arm through a plurality of outlet pipes, the discharged water freezing to form a thickened circular ice mass about the standpipe. Preferably the operation is continued at least until the circular ice mass becomes grounded on the marine bottom.

FIGS. 1 through 4 illustrate successive stages in a preferred embodiment of the method of this invention. Referring to FIG. 1, in the initial stages of the method water is pumped by pump 30 from water body 12 through a first fluid flow conduit defined by water supply line 26, standpipe 52 and swing arm 22; swing arm 22 is rotated above ice sheet 10 in a generally horizontal plane about the axis of standpipe 52; water is discharged from swing arm 22 through a first plurality of outlet pipes 44 to form circular ice mass 64 and through a second plurality of outlet pipes 44 to form annular ice mass 34. This operation is continued, as shown in FIG. 2, thereby building up the mass of ice masses 64 and 34 until the underlying sections of ice sheet 10 are deformed and become grounded on marine bottom 14.

FIG. 2 also illustrates the installation of water supply line 28 just below the surface of the ice island shortly after the ice island has become grounded. The grounding of the ice island will usually prohibit further use of water supply line 26. Accordingly, water supply line 26 is abandoned and water is thereafter pumped through a second fluid flow conduit defined by water supply line 28, standpipe 52 and swing arm 22 and the operation is continued to build up the top surface of ice bodies 46 and 48 to the desired elevation above the normal water level of water body 12, as illustrated in FIG. 3.

Although swing arm 22 is illustrated as a right cylindrical conduit having a horizontal axis, it is contemplated that an arcuate swing arm may be advantageously employed in this invention. The phrases "horizontal swing arm", "having a generally horizontal axis" and "rotated in a generally horizontal plane" are intended to include such arcuate swing arms and their use. These phrases should accordingly be broadly construed so as to include all the practical equivalents of swing arm 22.

Preferably the rotational speed of swing arm 22 and the rate of water discharged from each outlet pipe 44 are controlled to deposit relatively thin, uniform layers of water on the underlying ice, and the deposited water is allowed to freeze before additional water is deposited thereon. Swing arm 22 may be rotated, for example, at a rate of from 1 to 50 revolutions per day with the rate of water discharged being controlled in order to achieve these objectives. Preferably swing arm 22 is rotated at a rate between about 2 and about 10 revolutions per day with the water discharge rate being controlled to build up the ice mass at a rate of at least about 4 inches per day. Expressed another way, the layer of water deposited during each revolution of swing arm 22 may be from about 0.1 to about 5 inches in thickness, preferably between about 0.5 and about 2 inches in thickness, with the rate of revolution being controlled to permit freezing of the previously deposited water before more water is deposited on the same spot. Although the optimum combination of rotational speed and discharge rate will vary, depending primarily upon the ambient temperature, good results should be obtained when swing arm 22 is rotated at a rate of about five revolutions per day and water is discharged from outlet pipes 44 at a rate sufficient to deposit about a one-inch thick layer of water per revolution of spring arm 22.

As discussed above, water can be discharged from outlet pipes 44 onto the underlying ice in any desired pattern. Prior methods for building ice islands have required the construction of snow berms or other barriers to contain the discharged water within the desired area on the ice sheet. Although similar devices may be used with the apparatus and method of this invention, they are usually unnecessary and, in fact, are not preferred because such devices often block the wind thereby reducing the rate of heat transfer to the atmosphere and consequently the rate at which the deposited water freezes. When the rate of water discharge from outlet pipes is controlled to deposit the water in thin layers, as described above, the water will usually freeze before it can flow out of the desired pattern area. Problems with water leakage through the permeable snow berms are also avoided in this invention.

The invention is further illustrated by the following example which is illustrative of a specific mode of practicing the invention and is not intended as limiting the scope of the invention as defined by the appended claims.

EXAMPLE

A construction site is located in the Beaufort Sea, North Slope Basin, Alaska, for the construction of a grounded ice island. Water depth at the construction site is about nine feet. Construction is initiated in the fall of the year where the water body at the construction side is covered with a layer of "fast ice" ranging in thickness between about 1 foot and 2 feet. This thickness is sufficient to support the construction crew and their equipment.

Snow is scraped from the ice surface on the construction site and used to build snow fences upwind of the construction site. In accordance with this invention and substantially in accordance with the method and apparatus illustrated in FIGS. 1 through 4, water pump 30 is positioned at a first location on ice sheet 10 which is outside the ice island area. Water supply line 26 is run through ice sheet 10 into water body 12 to a second location on ice sheet 10 which corresponds to the desired center of the ice island. Standpipe 52 is extended through ice sheet 10 at this second location and is connected to water supply line 26 and supported by support structure 56.

Swing arm 22 is installed above ice sheet 10 as described above. Swing arm 22 has three spans of approximately 180 feet each with tractors 32 located along swing arm 22 at distances of 180 feet, 360 feet and 540 feet, respectively, from the axis of standpipe 52. A first plurality of sixteen outlet pipes 44 are spaced at 10 feet intervals along swing arm 22 between standpipe 52 and innermost tractor 32. A second plurality of nine outlet pipes 44 are spaced at 10 feet intervals along swing arm 22 at distances between 410 and 490 feet from standpipe 52.

Water is pumped from water body 12 through supply line 26, standpipe 52 and swing arm 22 to outlet pipes 44. Swing arm 22 is continuously rotated in a horizontal plane about standpipe 52 at a rate of about 5 revolutions per day and water is continuously discharged through outlet pipes 44 onto the underlying ice at a rate sufficient to deposit a substantially uniform layer of water about one inch deep in (1) a circular area around standpipe 52 having a diameter of about 170 feet and (2) an annular area having a width (i.e., a differential radius) of about 100 feet which is spaced between 400 and 500 feet from standpipe 52. The discharged water freezes on these sections of ice sheet 10 to form ice masses 64 and 34, respectively. This operation is conducted substantially continuously until ice bodies 46 and 48 become grounded on marine bottom 14 thereby forcing abandonment of water supply line 26.

Shallow trench 68 is then dug in the ice island and water supply line 28 is installed therein to interconnect water pump 30 and standpipe 52. Swing arm 22 is again rotated and water is pumped through supply line 28, standpipe 52 and swing arm 22 to outlet pipes 44 for deposit onto the underlying ice as described above. A freeboard of about 10 feet is thus built up on each of ice bodies 46 and 48 to complete the construction of the ice island.

While particular embodiments of the invention have been described it will be understood, of course, that the invention is not limited thereto since many obvious modifications can be made, and it is intended to include within this invention any such modification as will fall within the scope of the appended claims.

Having now described the invention, I claim:

1. An apparatus for distributing water onto a sheet of ice floating on a water body overlying a marine bottom in a cold offshore region so as to form a thickened ice mass, said apparatus comprising:

a water pump positioned at a first location on said ice sheet;

a fluid flow conduit comprised of (1) a first water supply line having an inlet end fluid-tightly connected to the outlet of said water pump and having at least a substantial portion of its length disposed in said water body between said ice sheet and said marine bottom, (2) a vertical standpipe fluid-tightly connected to the outlet end of said first water supply line, said standpipe extending through said ice sheet at a second location spaced from said first location, and (3) a horizontal swing arm rotatably and fluid-tightly connected to said standpipe and disposed in an elevated position above said ice sheet;

means for fixedly supporting said standpipe at said second location;

means for supporting said swing arm in said elevated position so as to be rotatable about said standpipe;

drive means for rotating said swing arm about said standpipe; and discharge means mounted on said swing arm for discharging water from said swing arm onto said ice sheet.

2. The apparatus defined in claim 1 wherein said fluid flow conduit further comprises a second water supply line disposed along the top surface of said thickened ice mass which fluid-tightly connects the outlet of said water pump to said standpipe.

3. The apparatus defined in claim 1 wherein said first location is spaced from said second location by a distance of at least the radius of said thickened ice mass.

4. The apparatus defined in claim 1 wherein at least the swing arm and standpipe sections of said fluid flow conduit are insulated by a first layer of thermal insulation.

5. The apparatus defined in claim 4 further comprising means for heating the insulated sections of said fluid flow conduit.

6. The apparatus defined in claim 1 wherein said discharge means comprises a first distributor means for distributing water from said swing arm onto said ice sheet in a circular pattern about said standpipe.

7. The apparatus defined in claim 6 wherein said discharge means further comprises a second distributor means for distributing water from said swing arm onto said ice sheet in an annular pattern about said standpipe, said annular pattern being spaced outwardly from said circular pattern.

8. The apparatus defined in claim 1 wherein said discharge means comprises at least one spray nozzle for spraying the water onto said ice sheet.

9. The apparatus defined in claim 8 further comprising a nozzle heater mounted on said spray nozzle for heating the water flowing through said spray nozzle.

10. An apparatus for distributing water onto a sheet of ice floating on a water body overlying a marine bottom in a cold offshore region so as to form a thickened ice mass, said apparatus comprising:

a water pump positioned at a first location on said ice sheet;

a first water supply line having at least a substantial portion of its length disposed in said water body between said ice sheet and said marine bottom, the inlet of said first supply line being fluid-tightly connected to the outlet of said pump;

an insulated vertical standpipe extending through said ice sheet at a second location spaced from said first location by at least the radius of said thickened ice mass, said standpipe having a first fluid inlet fluid-tightly connected to the outlet of said first supply line and a fluid outlet disposed above said ice sheet;

means for fixedly supporting said standpipe at said second location;

an insulated horizontal swing arm disposed in an elevated position above said ice sheet, said swing arm being rotatable about the vertical axis of said standpipe;

means for fluid-tightly and rotatably connecting said swing arm to the fluid outlet of said standpipe;

means for supporting said swing arm in said elevated position so as to be rotatable in a generally horizontal plane about said standpipe;

drive means for rotating said swing arm about said standpipe; and at least a first plurality of outlet pipes fluidtightly connected to said swing arm at selected spaced positions along its length, each of said outlet pipes including distributor means for distributing water from said swing arm onto said ice sheet.

11. The apparatus defined in claim 10 further comprising an insulated second water supply line disposed along the top surface of said thickned ice mass which fluid-tightly connects the outlet of said water pump to a second fluid inlet of said standpipe.

12. The apparatus defined in claim 10 wherein said standpipe and said swing arm are insulated by an inner layer of thermal insulation, an outer layer of thermal insulation, and a heating tape disposed between said inner and outer layers of thermal insulation; and wherein said apparatus further comprises means for controllably radiating thermal energy from said heating tape.

13. The apparatus defined in claim 10 wherein said first plurality of outlet pipes are positioned relatively close to said standpipe such that the water discharged therefrom freezes to form a thickened circular ice mass about said standpipe; and wherein said apparatus further comprises a second plurality of said outlet pipes fluid-tightly connected to said swing arm at selected spaced positions on a remote section of said swing arm, such that the water discharged from said second plurality of outlet pipes freezes to form a thickened annular ice mass spaced outwardly from and concentric with said circular ice mass.

14. The apparatus defined in claim 10 wherein said distributor means comprises a spray nozzle for spraying the discharged water onto said ice sheet, and wherein said outlet pipes are thermally insulated.

15. The apparatus defined in claim 14 further comprising a nozzle heater mounted on each of said spray nozzles for controllably heating the water flowing through said spray nozzles.

16. An apparatus for distributing water onto a sheet of ice floating on a water body overlying a marine bottom in a cold offshore region so as to form a thickened ice mass, said apparatus comprising:

a water pump positioned at a first location on said ice sheet outside the perimeter of said thickened ice mass;

a first water supply line having at least a substantial portion of its length disposed in said water body between said ice sheet and said marine bottom, the inlet of said first supply line being fluid-tightly connected to the outlet of said pump;

an insulated vertical standpipe extending through said ice sheet at a second location defining the center of said thickened ice mass, said standpipe having a first fluid inlet fluid-tightly connected to the outlet of said first water supply line and a fluid outlet disposed above said ice sheet;

means for fixedly supporting said standpipe at said second location;

an insulated pipe elbow;

means for fluid-tightly and rotatably connecting the fluid outlet of said standpipe to the inlet of said pipe elbow such that said pipe elbow is rotatable about the axis of said vertical standpipe;

an insulated horizontal swing arm disposed in an elevated position above said ice sheet and having an inlet fluid-tightly connected to the outlet of said pipe elbow, said swing arm being rotatable with said pipe elbow about said standpipe;

tractor means for rotatably supporting said swing arm in said elevated position and for rotating said swing arm in a generally horizontal plane about said standpipe; and first and second pluralities of outlet pipes fluid-tightly connected to said swing arm at selected spaced locations along its length, each of said outlet pipes including a spray nozzle for spraying water from said swing arm onto said ice sheet, the spaced positions of said first plurality of outlet pipes being selected such that the water sprayed therefrom freezes to form a thickened circular ice body about said standpipe and the spaced positions of said second plurality of outlet pipes being selected such that the water discharged therefrom freezes to form a thickened annular ice body spaced outwardly from and concentric with said circular ice body.

17. The apparatus defined in claim 16 further comprising an insulated second water supply line which fluid-tightly connects the outlet of said pump to a second fluid inlet of said standpipe, said second water supply line being disposed along the top surface of said thickened ice mass after said thickened ice bodies have become grounded on the marine bottom.

18. In the method for constructing a thickened ice mass in a cold offshore region wherein water is distributed onto a sheet of ice floating on a water body overlying a marine bottom, the improvement which comprises:

(a) pumping water from a source of water consecutively through (1) a first water supply line having at least a substantial portion of its length disposed in said water body between said ice sheet and said marine bottom, (2) a vertical standpipe extending through said ice sheet, and (3) a horizontal, rotatable swing arm disposed in an elevated position above said ice sheet;

(b) rotating said swing arm about said standpipe in a generally horizontal plane above said ice sheet; and (c) discharging water from the rotating swing arm onto said ice sheet, whereby said water freezes to form said thickened ice mass.

19. The method defined in claim 18 further comprising the step of (d) continuing to rotate said swing arm and to discharge said water onto said ice sheet at least until said thickened ice mass becomes grounded on the marine bottom.

20. The method defined in claim 19 further comprising the steps of (e) abandoning said first water supply line after said thickened ice mass has become grounded on said marine bottom; (f) installing a second water supply line along the top surface of said thickened ice mass; (g) thereafter pumping water from said source of water consecutively through said second water supply line, said standpipe and said swing arm; (h) rotating said swing arm in said generally horizontal plane; and (i) discharging water from the rotating swing arm onto said thicknened ice mass, whereby the discharged water freezes to build up the top surface of said ice mass to a preselected elevation above the normal surface of said ice sheet.

21. The method defined in claim 18 wherein the rotational speed of said swing arm and the water discharge rate are controlled to deposit relatively thin layers of water on said ice sheet during each revolution of said swing arm, with each thin layer of water being allowed to freeze to form ice before the next layer of water is deposited thereon.

22. The method defined in claim 21 wherein said thin layers of water are between about 0.1 and about 5 inches thick.

23. The method defined in claim 21 wherein said thin layers of water are between about 0.5 and about 2 inches thick.

24. The method defined in claim 18 wherein during step (c) water is discharged onto said ice sheet from both a first section and a second section of said swing arm, said first section being relatively near to said standpipe such that the water discharged therefrom freezes to form a thickened circular ice mass about said standpipe, and said second section being relatively remote from said standpipe and spaced from said first section such that the water discharged therefrom freezes to form a thickened annular ice mass spaced from and concentric with said circular ice mass.

25. The method defined in claim 24 further comprising the step of (d) continuing to rotate said swing arm and to discharge water from said first and second sections of said swing arm at least until said circular ice mass and said annular ice mass become grounded on said marine bottom.

26. In the method for building a grounded ice island in a cold offshore region wherein water is distributed onto a sheet of ice floating on a water body overlying a marine bottom, the improvement which comprises:

(a) pumping water from a source of water consecutively through (1) a first water supply line having at least a substantial portion of its length disposed in said water body between said ice sheet and said marine bottom, (2) a vertical standpipe extending through said ice sheet at the center of said ice island, and (3) a horizontal, rotatable swing arm disposed in an elevated position above said ice sheet;

(b) rotating said swing arm about said standpipe in a generally horizontal plane above said ice sheet;

(c) simultaneously discharging water onto said ice sheet from first and second sections of the rotating swing arm, said first section being relatively near to said standpipe such that the water discharged therefrom freezes to form a thickened circular ice mass about said standpipe, and said second section being relatively remote from said standpipe and spaced from said first section such that the water discharge therefrom freezes to form a thickened annular ice mass spaced from and concentric with said circular ice mass;

(d) continuing to rotate said swing arm at a preselected speed and to discharge water from said first and second sections of said swing arm onto said ice sheet at a preselected rate at least until said circular ice mass or said annular ice mass has sufficient weight to become grounded on said marine bottom thereby forming said ice island, the water discharge rate being selected to deposit the water in substantially uniform layers between about 0.5 and about 2 inches thick, and the rotational speed being selected to allow freezing of the discharged water to form ice before additional water is deposited thereon.

27. The method defined in claim 26 further comprising the steps of (e) abandoning said first water supply line when the grounding of said circular ice mass or said annular ice mass prohibits flow through said first water supply line; (f) installing a second water supply line along the top surface of said ice island; (g) thereafter pumping water from said source of water consecutively through said second water supply line, said standpipe and said swing arm; (h) rotating said swing arm in said generally horizontal plane; and (i) discharging water from said first and second sections of said swing arm onto said thickened ice masses, whereby the discharged water freezes to build up the top surfaces of said circular and annular ice masses to a preselected elevation above the normal surface of said ice sheet.

* * * * *